US008052071B2

(12) United States Patent
Kruse

(10) Patent No.: US 8,052,071 B2
(45) Date of Patent: Nov. 8, 2011

(54) FLUID RESERVOIR FOR A PAINT SPRAY GUN

(75) Inventor: Albrecht Kruse, Stuttgart (DE)

(73) Assignee: Sata GmbH & Co. KG, Kornwestheim (DE)

( * ) Notice: Subject to any disclaimer, the term of this patent is extended or adjusted under 35 U.S.C. 154(b) by 263 days.

(21) Appl. No.: 11/574,599

(22) PCT Filed: Aug. 13, 2005

(86) PCT No.: PCT/EP2005/008836

§ 371 (c)(1),
(2), (4) Date: Jul. 2, 2008

(87) PCT Pub. No.: WO2006/027084

PCT Pub. Date: Mar. 16, 2006

(65) Prior Publication Data

US 2009/0078789 A1 Mar. 26, 2009

(30) Foreign Application Priority Data

Sep. 7, 2004 (DE) ..... 10 2004 043 599

(51) Int. Cl.
*B05B 7/30* (2006.01)
*B05B 7/02* (2006.01)
*B65D 1/32* (2006.01)

(52) U.S. Cl. ..... 239/345; 239/327; 239/328; 239/525; 239/526; 206/816

(58) Field of Classification Search ..... 239/345, 239/326, 525, 526, 302, 327, 328, 346; 206/816
See application file for complete search history.

(56) References Cited

U.S. PATENT DOCUMENTS 2,008,381 A * 7/1935 Beeg ..... 401/139
4,784,184 A * 11/1988 Gates ..... 138/109

(Continued)

FOREIGN PATENT DOCUMENTS

AU 637187 5/1993

(Continued)

OTHER PUBLICATIONS

English language translation of International Preliminary Report on Patentability published Apr. 16, 2007 for PCT/EP2005/008836, filed Aug. 13, 2005.

(Continued)

*Primary Examiner* — Dinh Nguyen
*Assistant Examiner* — Justin Jonaitis
(74) *Attorney, Agent, or Firm* — Martin Fleit; Paul D. Bianco; Fleit Gibbons Gutman Bongini & Bianco PL

(57) ABSTRACT

The invention relates to a fluid reservoir for a paint spray gun, comprising a cup-shaped receptacle (1), a lid (2) that can be placed thereon (1) and a connecting part (3) which can be formed on the receptacle (1) or on the cover (2) and which is used to secure the fluid reservoir to the paint spray gun. According to the invention, a transition area (12) between the connecting part (3) and the receptacle (1) or the cover is embodied in a flexible manner in order to adjust the inclination of the receptacle (1) or the cover (2) in relation to the central axis (14) of the connecting part (3) in order to improve material guiding, even when the paint spray gun is inclined positions.

3 Claims, 2 Drawing Sheets

U.S. PATENT DOCUMENTS

| | | | | |
|---|---|---|---|---|
| 4,969,603 | A | 11/1990 | Norman | |
| 5,228,488 | A * | 7/1993 | Fletcher | 141/331 |
| 5,803,360 | A | 9/1998 | Spitznagel | |
| 6,053,429 | A | 4/2000 | Chang | |
| 6,536,684 | B1 | 3/2003 | Wei | |
| 6,712,292 | B1 | 3/2004 | Gosis et al. | |
| 6,843,390 | B1 * | 1/2005 | Bristor | 222/145.5 |
| 6,877,677 | B2 * | 4/2005 | Schmon et al. | 239/346 |
| 2004/0104194 | A1 * | 6/2004 | Dennison | 215/379 |
| 2004/0140373 | A1 | 7/2004 | Joseph et al. | |
| 2004/0245208 | A1 * | 12/2004 | Dennison | 215/379 |
| 2005/0220943 | A1 * | 10/2005 | Abrams et al. | 426/130 |
| 2008/0264892 | A1 * | 10/2008 | Nozawa | 215/40 |

FOREIGN PATENT DOCUMENTS

| | | |
|---|---|---|
| DE | 8902223.8 | 5/1989 |
| DE | 4302911 | 8/1993 |
| EP | 0524408 | 1/1993 |
| EP | 0801002 | 10/1997 |
| WO | WO 90/08456 | 8/1990 |
| WO | WO 03/069208 | 8/2003 |

OTHER PUBLICATIONS

Written Opinion published Mar. 7, 2007 for PCT/EP2005/008836, filed Aug. 13, 2005.

International Search Report published Mar. 16, 2006 for PCT/EP2005/008836, filed Aug. 13, 2005.

* cited by examiner

FLUID RESERVOIR FOR A PAINT SPRAY GUN

FIELD OF THE INVENTION

The invention pertains to a fluid reservoir for a paint spray gun.

BACKGROUND OF THE INVENTION

Conventional fluid reservoirs for paint spray guns usually feature a cup-shaped receptacle, the underside of which is provided with an opening and a connecting part for detachably connecting the receptacle to the upper side of the paint spray gun. The connecting part is usually realized in the form of a connection piece that is arranged on the bottom of the receptacle and features an external thread that is screwed into a corresponding threaded opening on the upper side of the paint spray gun. In conventional fluid reservoirs, the connecting part is normally arranged rigidly on the receptacle. However, this results in the receptacle assuming a horizontal or nearly horizontal position when it is attached to the paint spray gun and the paint spray gun is held in certain inclined positions. In this case, the feed of the paint to the paint spray gun may no longer be ensured under certain circumstances.

SUMMARY OF THE INVENTION

The invention is based on the objective of developing a fluid reservoir of the initially mentioned type that makes it possible to improve the material feed, namely also when the paint spray gun is held in inclined positions.

This objective is attained with a fluid reservoir with the characteristics as set forth in the claims. Practical embodiments and advantageous additional refinements of the invention form the objects of the dependent claims.

One significant advantage of the inventive fluid reservoir can be seen in that the fluid receptacle can be inclined relative to the connecting part. If so required, the inclination of the fluid reservoir attached to the paint spray gun can be changed in order to also ensure the inflow of paint if the paint spray gun is significantly inclined. This adjustability is realized in that the transition area between the connecting part and the receptacle or the cover is realized in a flexible fashion. The connecting part for detachably Fixing the fluid reservoir on the paint spray gun may be arranged on the receptacle or on the cover. If the connecting part is arranged on the cover, the receptacle is situated upside down in its operative position.

In one embodiment of the invention that provides certain advantages with respect to the manufacturing technology, the wall thickness changes from a greater wall thickness on the connecting part to a lesser wall thickness on the receptacle or the cover in the transition area between the connecting part and the receptacle or the cover.

In another embodiment, the transition area may also be realized, for example, in the form of a bellows or the like.

BRIEF DESCRIPTION OF THE DRAWINGS

Other special features and advantages of the invention result from the following description of one preferred embodiment that refers to the figures. Shown are.

DETAILED DESCRIPTION OF THE INVENTION

Figure 1:
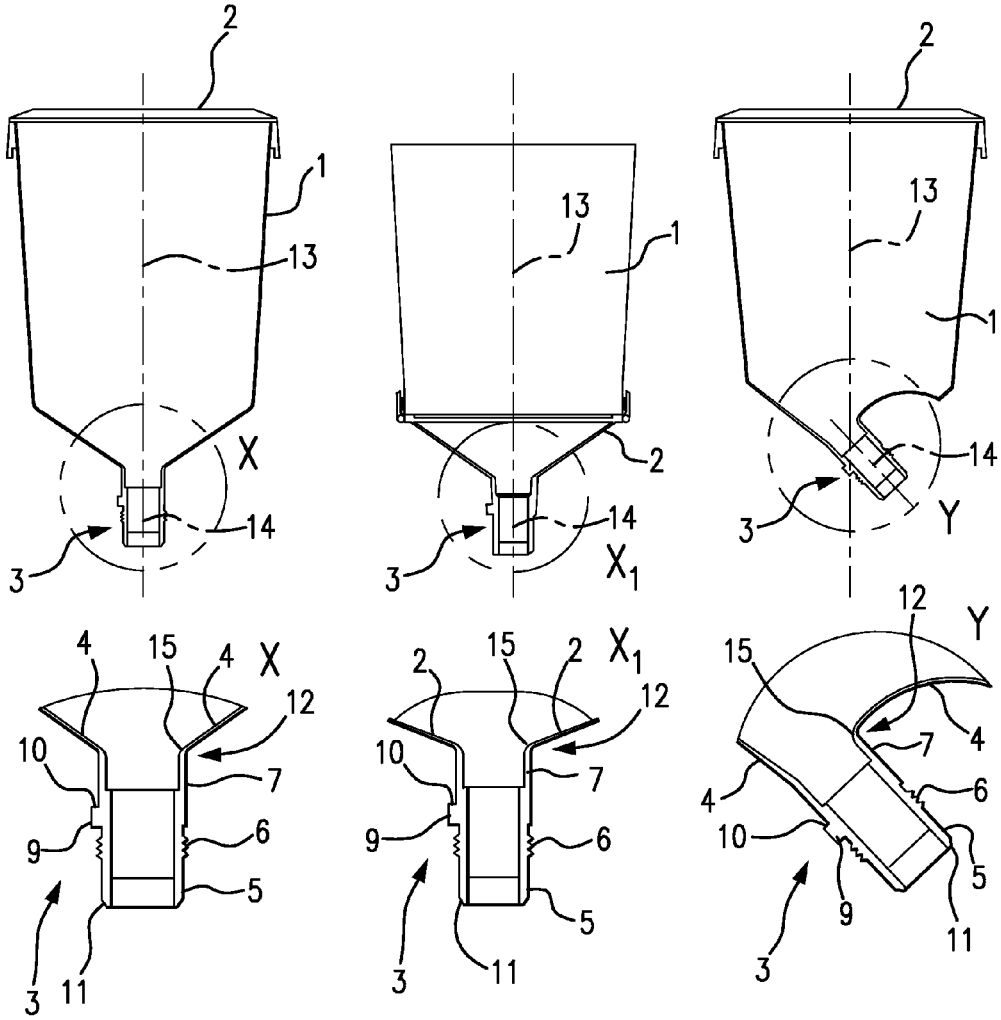
FIG. 1, a first embodiment of an inventive fluid reservoir with a straight and an inclined connecting part, wherein the areas X, X1 and Y are illustrated in an enlarged fashion, with area X1 showing the outlet spout integral with the cover, and FIG. 2, a second embodiment of an inventive fluid reservoir with a straight and an inclined connecting part, wherein the areas X and Y are illustrated in an enlarged fashion.
Figure 2:
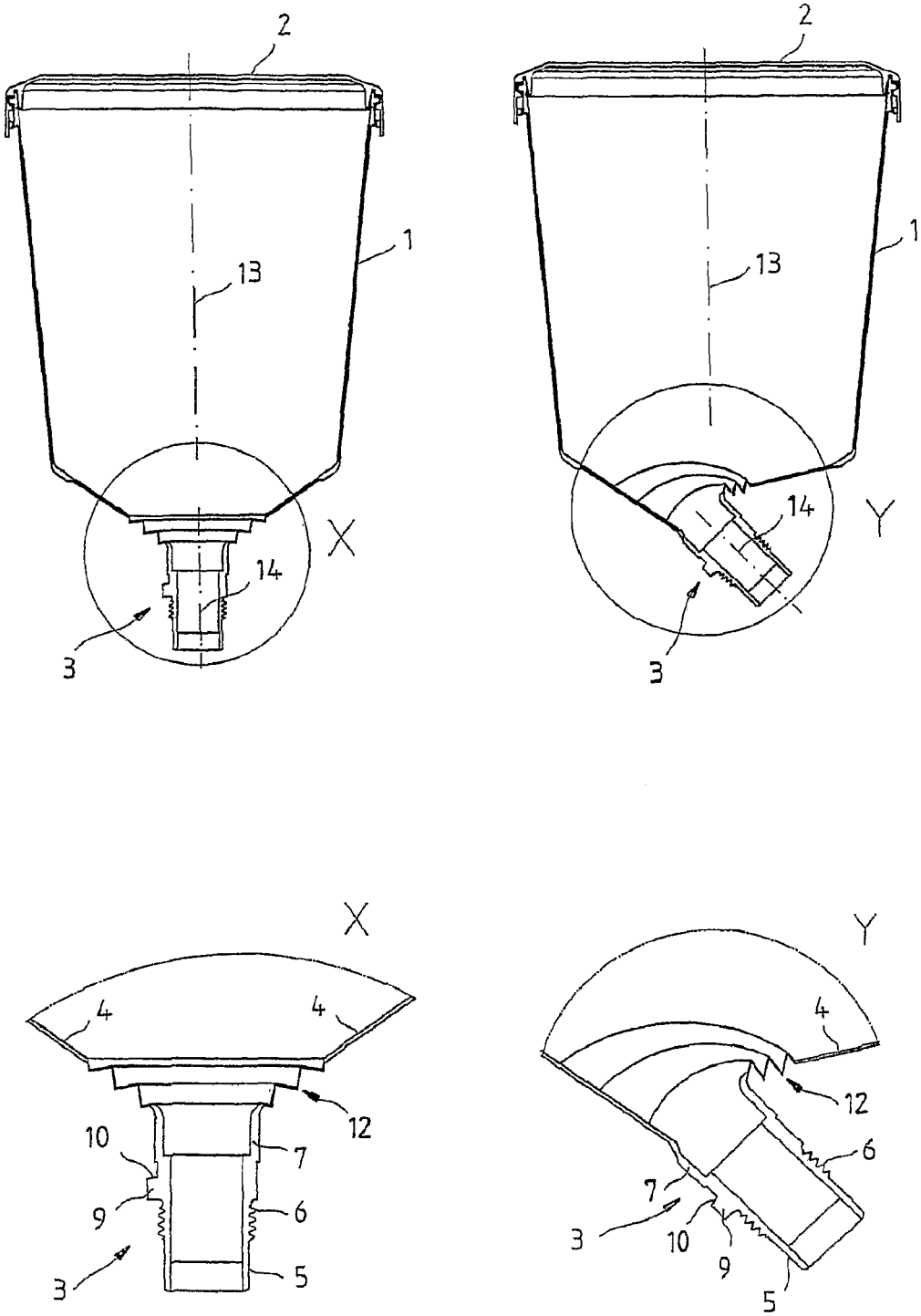

The fluid reservoirs for a paint spray gun illustrated in FIGS. 1 and 2 comprise a cup-shaped receptacle 1, a cover 2 that can be attached to the receptacle 1 and a connecting part 3 that is integrally molded onto the receptacle 1 and that serves for detachably fixing the receptacle 1 on a paint spray gun. The receptacle 1 with the connecting part 3 integrally molded thereon as well as the cover 2 are realized in the form of injection-molded parts of an elastic, non-embrittling plastic material. These requirements are fulfilled, e.g., with plastics consisting of PE or plastics with high PE content.

The enlarged details X and Y in FIGS. 1 and 2 show that the connecting part 3 consists of a tubular connection piece that is integrally molded or otherwise integrally connected to the conical bottom 4 of the receptacle 1, wherein this tubular connection piece comprises a hollow-cylindrical front area 5, an adjacent external thread 6 for screwing into a conventional internal thread, a screw-type wedge element that is arranged above the external thread 6 and that serves for realizing a rapid-action coupling between the fluid reservoir and the paint spray gun, and an upper insert area 7 with an inner annular contact surface 8 for inserting a conventional filter. In the embodiment shown, the screw-type wedge element is formed by a wedge-shaped projection 9 with a wedge surface 10 that extends approximately over half the circumference of the connecting part 3 and engages with a corresponding mating surface on an attachment or projection of the paint spray gun. The projection 9 with the wedge surface 10 and the corresponding mating surface on the paint spray gun are realized in such a way that the receptacle 1 can already be tightly fixed on the paint spray gun by turning the two components relative to one another by one-quarter to one-half revolution. The front face 11 of the connecting part 3 is pressed against a corresponding sealing surface within the paint spray gun in this case. The additional external thread 6 makes it possible to utilize the fluid reservoir on paint spray guns that are not equipped with a corresponding fitting for the screw-type wedge element, but rather a conventional internal thread.

In the fluid reservoirs shown in FIGS. 1 and 2, the transition area 12 between the connecting part 3 and the bottom 4 of the reservoir 1 is realized in a flexible fashion such that the angular position of the central axis 13 of the reservoir 1 can be adjusted relative to the central axis 14 of the connecting part 3. The transition area 12 is realized in such a way that the reservoir 1 can be held at a desired incline after it is screwed on the paint spray gun and does not automatically pivot back into its normal position. If so required, the reservoir 1 can be pivoted back into its normal position or into another inclined position. The fluid reservoir is illustrated in its normal position in the left portions of FIGS. 1 and 2. In this position, the central axis 13 of the reservoir 1 coincides with the central axis 14 of the connecting part 3. In the right portions of these figures, the reservoir 1 is inclined relative to the connecting part 3. The central axis 14 of the connecting part 3 is angled relative to the central axis 13 of the reservoir 1 in this case.

In the embodiment shown in FIG. 1, the transition area 12 between the connecting part 3 and the reservoir 1 is realized in such a way that the wall thickness changes from a greater wall thickness on the insert area 7 of the connecting part 3 to a lesser wall thickness on the bottom 4 of the reservoir. The difference in wall thickness at the transition area amounts to at least 30%. This ensures that the bottom 4 of the reservoir 1 can be bent without creating cracks and that any impairment of the insert area 7 of the connecting part 3 is simultaneously prevented. Due to this measure, the inner contour of the connecting part 3 that accommodates the filter is also maintained when the reservoir 1 is pivoted. A radius 15 is provided at the transition from the connecting part 3 to the bottom 4 of the reservoir 1. This ensures that the reservoir 1 is not damaged or bent in this region when it is inclined.

In the embodiment shown in FIG. 2, the transition area 12 is realized in the form of a bellows. The reservoir 1 can also be inclined relative to the connecting part 3 in this embodiment.

The invention is not limited to the embodiments that were described above and are illustrated in the figures. For example, the connecting part 3 may also be integrally molded to the cover. In this case, the reservoir may have a conventional cup-like shape with a straight bottom surface that does not feature a connecting part. The cover provided with the connecting part can be attached to the reservoir after it is filled and the fluid reservoir can then be inserted into the opening of a paint spray gun that is held in an upside down position. The paint spray gun is subsequently turned over such that the fluid reservoir is situated on the upper side of the paint spray gun. The venting of the fluid reservoir is realized, e.g., by the opening of a vent valve provided on the bottom of the fluid reservoir or by piercing an initially closed venting duct with the aid of a pin or the like. The utilization of a vent valve that can be reclosed after the paint spray gun is used or a vent opening that can be resealed provides the advantage that the fluid reservoir can also be used for storing paint that was not used in its entirety.

The invention claimed is:

1. A fluid reservoir for a paint spray gun, said reservoir comprising a cup shaped receptacle having a first central axis for holding paint to be gravity fed into a paint spray gun, a cover that is attached to and closes the receptacle and a conical bottom that is attached to an outlet spout having a second central axis through which paint in said receptacle can flow by gravity into a paint spray gun, said outlet spout being integrally molded as part of the reservoir and serves for fixing the fluid reservoir on a paint spray gun to enable paint in said receptacle to flow by gravity through said outlet spout into said paint spray gun, said outlet spout composed of a tubular connection piece of preselected wall thickness that includes a hollow cylindrical front area, an adjacent external thread for being screwed into an internal thread on an inlet port of a paint spray gun, a screw-type wedge above the external thread for rapid coupling to a paint spray gun and an upper insert area with an annular contact surface to receive a filter, and wherein the screw type wedge is formed by a wedge shaped projection with a wedge surface that extends over approximately half the circumference of the outlet spout for engagement with a corresponding mating surface on a paint spray gun;

a flexible transition area composed of an elastic non-embrittled plastic material having a high PE content formed at the conical bottom of the reservoir where it joins with the outlet spout to provide flexibility in order to enable adjustment of the inclination of the first central axis of the receptacle of the reservoir relative to the second central axis of the outlet spout of the reservoir so that the reservoir can be maintained in a vertical orientation, said transition area being characterized by a radius to insure that the transition area is not damaged when the outlet spout is operatively fixed in a paint spray gun to enable gravity flow of reservoir content into the paint spray gun and the reservoir is inclined relative to the outlet spout so that the first central axis of the receptacle of the reservoir can be maintained vertical regardless of the inclination of the second central axis of the outlet spout of the reservoir, said transition area having a wall thickness that is at least 30% less than the preselected wall thickness of the outlet spout whereby during gravity feed of paint from the receptacle to a paint spray gun, the receptacle can be placed stably at a vertical orientation with respect to the second central axis of the outlet spout and thereby assure continuous gravity feed of paint into the paint spray gun regardless of the paint spray gun's orientation and thus allows for uninterrupted operation of the paint spray gun.

2. The fluid reservoir according to claim 1, wherein the outlet spout is integrally formed with the receptacle.

3. The fluid reservoir according to claim 1, wherein the outlet spout is integrally formed with the cover.

* * * * *